US005915326A

United States Patent [19]

Karal

[11] Patent Number: 5,915,326

[45] Date of Patent: Jun. 29, 1999

[54] SUBSEA MOORING

[76] Inventor: Karel Karal, Rugdeveien 5, Oslo, Norway, N-0386

[21] Appl. No.: 08/803,645

[22] Filed: Feb. 21, 1997

[51] Int. Cl.[6] ..... B63B 21/24

[52] U.S. Cl. ..... 114/294

[58] Field of Search ..... 114/293, 294–297; 405/195, 224–228, 231, 232

[56] References Cited

U.S. PATENT DOCUMENTS

| | | | |
|---|---|---|---|
| 2,556,279 | 6/1951 | Johnson | 114/294 |
| 3,180,304 | 4/1965 | Brady . | |
| 3,496,900 | 2/1970 | Mott et al. . | |
| 3,516,379 | 6/1970 | Skoog . | |
| 4,036,161 | 7/1977 | Nixon | 114/296 |
| 4,710,061 | 12/1987 | Blair et al. | 405/195 |
| 4,733,993 | 3/1988 | Andréasson . | |

FOREIGN PATENT DOCUMENTS

| | | | |
|---|---|---|---|
| 0011894 | 6/1980 | European Pat. Off. . | |
| 3144728 | 5/1983 | Germany | 114/293 |
| 445473 | 11/1984 | Sweden . | |
| 1451537 | 10/1976 | United Kingdom . | |
| 2227988 | 8/1990 | United Kingdom . | |

*Primary Examiner*—Ed L. Swinehart
*Attorney, Agent, or Firm*—Browdy and Neimark

[57] ABSTRACT

A suction anchor for mooring systems, especially from floating installations for offshore production of oil and gas. The anchor is made in the form of a hollow cylindrical body (2) that is open at both ends and is completely embedded in the seabed (1), i.e. it is surrounded by seabed mass on all sides. Such a deep siting of the anchor (2) results in several advantages. For instance, the anchor (2) will penetrate to a depth with presumably firmer masses. The danger of a split on the back of the anchor is also avoided. The anchor can be left behind after use, because it lies at an approved depth. The anchor is mounted by means of a top piece designed as an inverted beaker-shaped part provided with a vent hole so that the anchor can be suction penetrated. The top piece is recovered and used again for lowering other similar anchors. Advantageous embodiments/sitings of the anchor cable (5,7) connected to the anchor are also described.

11 Claims, 8 Drawing Sheets

SUBSEA MOORING

The invention relates to a subsea mooring comprising one more hollow cylindrical bodies which are penetrated into the seabed, and an anchor cable connected thereto.

Suction anchors for mooring or anchoring systems are known, especially for floating installations that are used for offshore production of oil and gas. Such suction anchors are made in the form of inverted cup or beaker-shaped bodies, the cylindrical part or casing of which is pressed down into the seabed by means of negative pressure in the closed-off space, which is delimited by the casing and the beaker bottom or anchor top. A ready installed anchor of this kind projects somewhat above the level of the seabed. One of the objectives of the invention is to improve such known suction anchors.

This is achieved according to the invention in that the hollow cylindrical body is a hollow cylinder that is open at both ends and is completely embedded in the seabed, with seabed mass on all sides.

A subsea mooring of this kind has several new characteristics and considerable advantages.

The anchor will lie at a depth where there are firm masses, and the anchor can therefore be made smaller for the same load compared with conventional suction anchors. As known, the top two to four metres of the seabed is often a soft layer. The capacity of the anchor will also increase considerably because there is no longer any danger of a split at the back of a chiefly horizontally loaded anchor, where water could flow in and reduce capacity.

As the anchor lies completely embedded in the seabed, it will not have any contact with oxygenous sea water and will therefore not be exposed to corresponding corrosion . It will not be necessary to remove the anchor after it has been used. This is because the anchor has penetrated to a sufficient depth beneath the level of the seabed (a depth which is prescribed by the authorities). The anchor will not constitute an obstacle to fishing.

According to the invention, a plurality of hollow cylinders that are open at both ends can be assembled in a group. The individual cylinders may be spaced apart at equal intervals and connected to one another by means of vertical plate members, preferably curved in the horizontal plane.

According to the invention, the hollow cylinders may to advantage consist of a number of component hollow cylinders that are coupled together end-to-end. A construction of this kind is expedient with a view to being able to achieve a great degree of standardisation and thereby savings as a result of simplified projecting and fabrication.

When the hollow cylinder consists of a plurality of component hollow cylinders that are coupled together end-to-end it will be possible to build the anchor up with a mid-portion which will be the same for all anchors of the same diameter and anchoring load, irrespective of seabed conditions. Adaptations to specific seabed conditions are made by proportioning the height of, e.g., the upper and lower extension pieces or component hollow cylinders, which are mounted on a mid-portion, such that in this way a desired total height of the anchor can be obtained. These component hollow cylinders or extension pieces may have fixed dimensions (wall thickness, optional braces), with the exception of the actual height which must be proportioned in each case on the basis of the seabed conditions in question.

It is especially advantageous if a tangentially positioned plate can be provided on the outside of the casing of the hollow cylinder. A plate of this kind will increase the capacity of the anchor and will also increase the anchor width. The increased anchor width will make it possible to secure two or more anchor lines at a distance that is sufficient to prevent the lines from striking against each other if they are set in motion.

The said plate can to advantage be braced against the hollow cylinder with support plates which extend from the plate in towards the casing.

Since the hollow cylinder or anchor lies embedded in the seabed, with seabed mass on all sides, the part of the anchor line or anchor cable which lies closest to the anchor must also be penetrated. To avoid undesirable bending moment in the anchor cable a couple of specific measures are proposed according to the invention.

For instance, the anchor cable may to advantage comprise a chain length extending from the hollow cylinder and up towards the seabed, said chain length in the seabed penetration area being connected to a plate body which lies on the seabed and is connected to the anchor cable which continues to run up in the sea.

The chain length is proportioned so that the upper end thereof exits the earth masses at the same angle that the anchor cable (which cannot withstand large bending moment) has at the transition between these two parts of the anchor line. To achieve this, a sufficient length of chain must be chosen which withstands all bending, but this chain comes as an additional length to the anchor cable (whose length is determined by other considerations). Since the chain is expensive, it is important that it be as short as possible. The idea here is that its minimum length is determined on the basis of theoretical considerations based on the penetration resistance to which it will be exposed. Instead of adding an extra length, which would provide an adequate safety margin, the chain is terminated in a low-cost plate which will come into use if the chain length is undersized. The plate is so large that it cannot penetrate in its entirety, only in part. A moment-free connection between the plate and the "fragile" anchor chain ensures that the anchor cable will not be subjected to bending, even in the event of the chain length being undersized.

An alternative solution according to the invention is one where the anchor cable in the region extending from the hollow cylinder and up to the seabed has a number of preferably cylindrical bodies threaded thereon, rather like pearls on a string. The preferably cylindrical bodies will create an even curve of the penetrated portion of the anchor cable and will also protect the cable against wear during the penetration into the masses and later on movement of the cable.

The diameter of said bodies may to advantage decrease the further the distance from the hollow cylinder or anchor.

The invention makes possible penetration of one or more hollow cylindrical bodies into a seabed. NO-PS 176,625 makes known the penetration of a hollow cylindrical body into the seabed using suction and/or flushing or similar, in that a hollow cylinder, which is open at both ends, is provided and a hollow cylindrical inverted beaker-shaped top piece having an upper vent hole and a lower mouth. The hollow cylinder is connected to the top piece, end to mouth, so that an assembled inverted beaker-shaped body is formed which is then made to penetrate the seabed. The method and device which is known from NO-PS 176,625 do not, however, relate to a subsea mooring, but concern protection of a subsea wellhead Christmas tree. With the present invention, the hollow cylinder can be attached to an anchor cable or a part thereof prior to the penetration, and when penetration has been completed, with the hollow cylinder in a known way per se completely embedded in the seabed, the top piece is released and recovered before the hollow cylinder is put into service as an anchor.

Not all seabed masses are suitable for obtaining desired penetration by means of suction. This is true in particular of hard and heavily layered masses. For installation in masses where the gravitation and suction forces will not be sufficient for penetration of the anchor to the desired depth, the anchor according to the invention can be made to penetrate under the exertion of shearing forces along the lower free end of the hollow cylinder. A mechanical digging and/or removal of masses below the hollow cylinder is thereby achieved. The penetration resistance can in a known way be reduced further by supplying water under pressure in the digging zone. Further reduction can also be obtained by pumping out loosened masses from the digging zone. When exerting the said shearing forces, it is possible to a certain degree to guide the hollow cylinder according to need in order to achieve the desired vertical penetration.

It will be especially advantageous to allow the hollow cylinder to be composed of a number of component hollow cylinders. A construction of this kind will make possible adaptations to specific seabed conditions, since with a standard mid-portion of the hollow cylinder as a starting point, it is possible to affix upper and lower component hollow cylinders or extension pieces proportioned (in height) in accordance with the seabed conditions in question.

In order to provide the new subsea mooring and by carrying out the new method, according to the invention a device is also provided. Here too, the device which is known from NO-PS 176,625 is taken as the point of departure.

Thus, a device is proposed according to the invention for use when penetrating a hollow cylinder that is open at both ends into a seabed, comprising a hollow cylindrical inverted beaker-shaped part having an upper vent hole and a lower mouth designed for contact and releasable coupling to one end of the open-ended hollow cylinder, characterised in that the inverted beaker-shaped part has a loose beaker bottom attached so as to be limitedly moveable in the direction of the cylinder axis, with locking means for clamping and locking the beaker bottom to the adjacent casing end of the inverted beaker-shaped part, and preferably having a ring gasket between the beaker bottom and the adjacent casing end of the inverted beaker-shaped part, and a ring gasket on the mouth end facing the open-ended cylinder.

Such an embodiment of the said hollow cylindrical inverted beaker-shaped part, hereinafter designated top piece, results in a number of advantages.

The beaker bottom or cylinder cover will be open, i.e. , it will be located at a distance from the adjacent casing end of the hollow cylinder during the lowering of the anchor from the surface down to the seabed. Efficient ventilation is obtained and the anchor is able to pass the critical wave zone without any danger of the waves lifting the anchor and taking up the tension in the lowering wire, which could result in a very dangerous jerk of the wire, or the reverse, namely loading the anchor with great downwardly directed force. The beaker bottom or cylinder cover is held in a safe, open position in that the lowering wire is attached to the cylinder cover.

When the top piece, with attached hollow cylinder or anchor, encounters the seabed the anchor will rapidly undergo a first part of the penetration by means of its own weight and the weight of the top piece, so-called weight penetration. This weight penetration can be carried out quickly and without any danger of internal positive and negative pressure which could result in channel formation along the wall, which in turn could result in leaks and a diminished ability to suck the anchor down to the desired depth. An internal positive pressure in a closed anchor (a problem complex familiar from all known suction anchors) may also result in the anchor overturning before it has started to penetrate. This is avoided by means of the special design of the cylinder cover because the beaker bottom or cylinder cover will be open during the initial penetration by means of its own weight. This new characteristic according to the invention will give a more secure installation, simpler and reduced needs for both projecting, instrumentation and technical expertise, and will increase the extent of the spell of weather which is suitable for carrying out the installation.

Suction penetration is carried out in a known way in that the cylinder cover is closed, i.e., brought into close contact with the adjacent hollow cylinder casing end.

Locking means are advantageously provided for clamping and locking the beaker bottom to the adjacent casing end of the inverted beaker-shaped part. It is especially advantageous if a ring gasket can be inserted between the beaker bottom and the adjacent casing end of the inverted beaker-shaped part.

After the suction penetration or simultaneous therewith, especially in masses where the gravitation and suction forces are not sufficient for the penetration of the anchor to the desired depth, a mechanical digging and/or removal of mass beneath the anchor can be carried out.

Once penetration has been completed, the top piece is to be removed for re-use in lowering another, similar anchor, and the top piece must therefore be capable of being released and raised easily once penetration to the desired depth has been completed.

It is especially advantageous according to the invention if locking means can be provided on the top piece or the inverted beaker-shaped part for locking onto the hollow cylinder, which locking means after the penetration can be broken above the seabed.

A particularly simple and advantageous solution in this connection is one where the locking means comprise a wire loop around a pin or similar on the outer casing surface of the hollow cylinder.

The wire loop may to advantage be connected to the inverted beaker-shaped part in such manner as to be capable of being tightened and released. Should the release mechanism fail, the release can take place by cutting the wire, for example with the aid of a ROV.

The invention also relates to a hollow cylinder designed to be used as an anchor penetrated in the seabed.

It is especially advantageous for a hollow cylinder of this kind to consist of a number of component hollow cylinders that are coupled together end-to-end. This makes possible a large degree of standardisation and thereby savings as a result of simplified projecting and fabrication. The hollow cylinder can to advantage be built up of a component hollow cylinder that constitutes a mid-portion, and which will be the same for all anchors of the same diameter and anchoring load, irrespective of seabed conditions. The adaptation to particular seabed conditions can be made by proportioning the height of, for example, an upper and lower extension piece (component hollow cylinder) which is mounted on the mid-portion, so that in this way the desired total height of the anchor, determined on the basis of the seabed conditions in question, is obtained.

It is especially advantageous if on the outside of the casing of the hollow cylinder a tangentially positioned plate can be provided. A plate of this kind will increase the capacity and width of the anchor. If the hollow cylinder is built up of several component hollow cylinders coupled together end-to-end, e.g., three component hollow cylinders, it is advantageous for the plate to be located on the middle component hollow cylinder, which is the element that is attached to the anchor cable.

It is especially advantageous if the hollow cylinder, which is open at both ends, can at one end thereof have arranged cutting elements and means attached to the hollow cylinder for operating the cutting elements in order to move them backwards and forwards in the peripheral direction of the hollow cylinder. These cutting elements can to advantage be used for digging when the gravitation and suction forces are not sufficient for penetration to the desired depth. The cutting elements are moved backwards and forwards in opposite directions so that rotational torque, which could set the whole anchor in motion before sufficient resistance in the surrounding earth masses has been developed, is avoided. The cutting movements result in a weakening of the earth masses and a reduction of the penetration resistance. The penetration resistance may optionally be reduced further by the supply of water under pressure in the digging zone, which is known per se. Further reduction can in a known way also be achieved by pumping out loosened masses from the digging zone. The cutting elements or digging equipment can be used to guide the anchor to the desired vertical penetration, by using independent control of the cutting elements.

Said means can to advantage comprise fluid power cylinders arranged in end recesses in the casing of the hollow cylinder.

The invention will now be explained in more detail with reference to the drawings, wherein.

Figure 1:
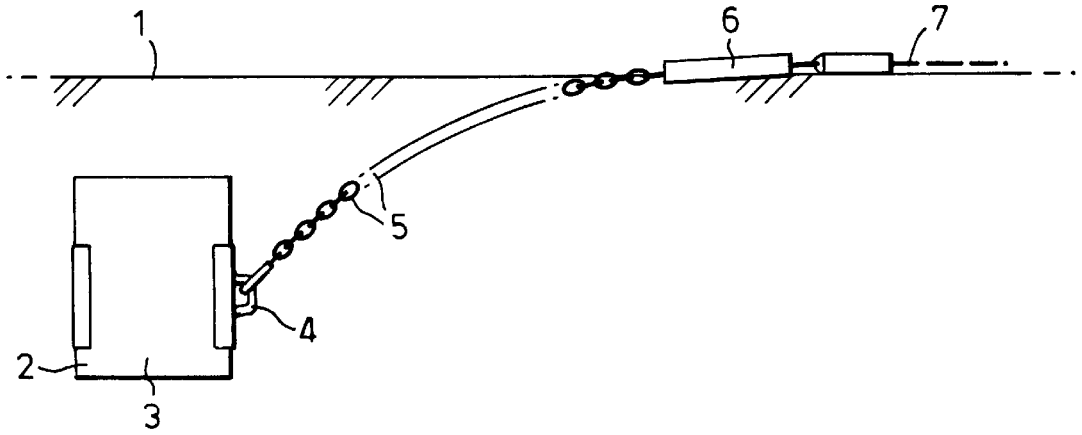
FIG. 1 illustrates a subsea mooring according to the invention.

FIG. 1 illustrates a seabed mooring. An anchor 2 is completely embedded in the seabed 1. The anchor is constructed in the form of a hollow cylindrical body, open at both ends, and having a vertical cylinder axis 3. The anchor or hollow cylinder 2 has an attachment eye 4 on the side of the casing thereof, attached to an anchor cable, here comprising a chain length 5 which extends up to the seabed 1, where the chain length is connected to a plate-shaped body 6. This plate-shaped body 6 rests on the seabed 1 and is at the other end thereof connected to the anchor cable 7 which runs up in the sea.

The chain length is proportioned so that the upper end thereof exits the earth masses at the same angle that the anchor cable (which does not withstand large bending moment) has at the transition between these two parts of the anchor line. To achieve this, a sufficient length of chain must be chosen which withstands all bending, but this chain comes as an additional length to the anchor cable (the length of which is determined by other considerations). Since the chain is expensive, it is important that it be as short as possible. The idea here is that its minimum length is determined on the basis of the penetration resistance to which it is exposed. Instead of an extra length, which would provide an adequate safety margin, the chain ends in a low-price plate which comes into use if the chain length is undersized. The plate is so large that it cannot penetrate in its entirety, only in part. A moment-free connection between the plate and the "fragile" anchor cable ensures that the anchor cable is not exposed to bending, even in those cases where the chain length is undersized.

Figure 2:
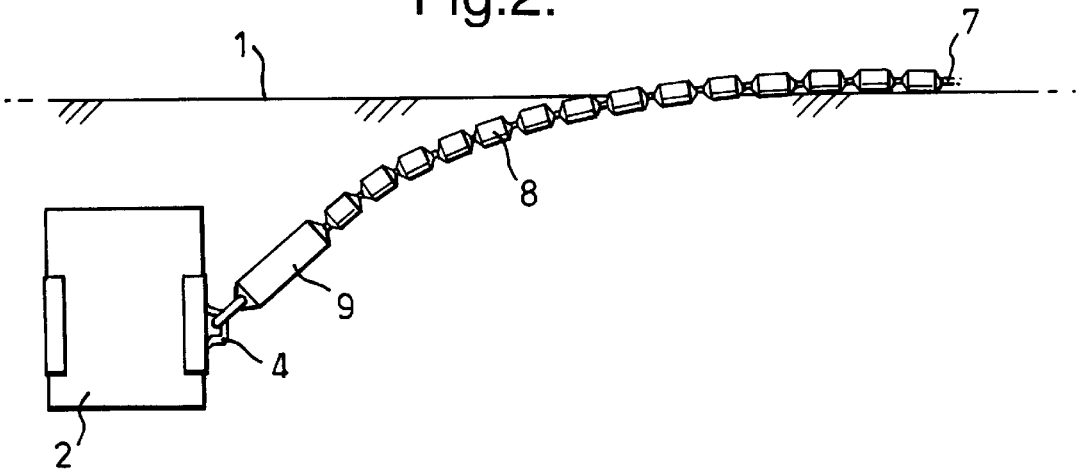
FIG. 2 illustrates a second embodiment of a subsea mooring according to the invention.

In FIG. 2 the same anchor 2 is shown completely embedded in a seabed 1. The anchor cable 7 here is directly attached to the attachment lug 4, but has a plurality of preferably cylindrical bodies 8 threaded thereon, like pearls on a string. These cylindrical bodies 8 will create an even curvature of the penetrating part of the anchor cable 7. It is especially important that the bodies be of the same diameter as an end piece 9, so that the same penetration resistance is achieved with even curvature of the anchor cable as a consequence. Moreover, the bodies 8 will protect the anchor cable 7 against wear during the penetration into the seabed masses, and later on movement of the anchor cable. It is not shown, but the diameter of the bodies 8 may decrease the further the distance from the anchor.

The anchor in FIGS. 1 and 2 have been penetrated to a depth where firmer masses are found. The anchor can therefore be proportioned smaller for the same load compared with conventional suction anchors. The top two to four metres of the seabed will often be a soft layer, and it is of advantage for the anchor to be penetrated to below this soft layer.

When the anchor is loaded there will be a danger of a split in the back of a loaded suction anchor, where water can flow in which will reduce the anchor's capacity. This applies to suction anchors which end at or just above the level of the seabed. This danger is avoided by means of a completely embedded anchor according to the invention.

It is also an advantage that the anchor is not in contact with oxygenous sea water. Once the anchor has performed its task, i.e., it is taken out of service, there is no need to remove the anchor, precisely because it has been penetrated completely to a sufficient depth below the level of the seabed, and the anchor can therefore remain at a depth which is equal to or greater than that prescribed by the authorities. The completely embedded anchor will not constitute an obstacle to fishing.

Figure 3:
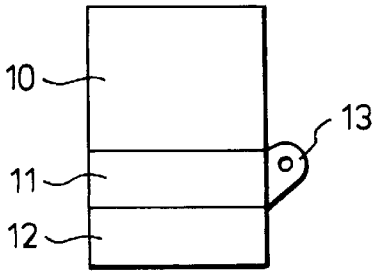
FIG. 3 illustrates an anchor consisting of three parts.

FIG. 3 shows an anchor which in an advantageous manner consists of three component hollow cylinders 10, 11, and 12. The middle component hollow cylinder or midportion 11 is provided with an attachment lug 13 for the anchor cable (not shown). The midportion 11 may be identical for all anchors of the same diameter and anchor load, irrespective of seabed conditions. This makes possible a great degree of standardisation. The adaptation to specific seabed conditions is carried out by proportioning the height of the upper and lower component hollow cylinders 10, 12 on the basis of the seabed conditions in question, so that the desired total height of the anchor is obtained. These extension pieces 10 and 12 may have fixed dimensions (wall thickness, optional braces) with the exception of the actual height, which is the dimension that is adapted.

Figure 4:
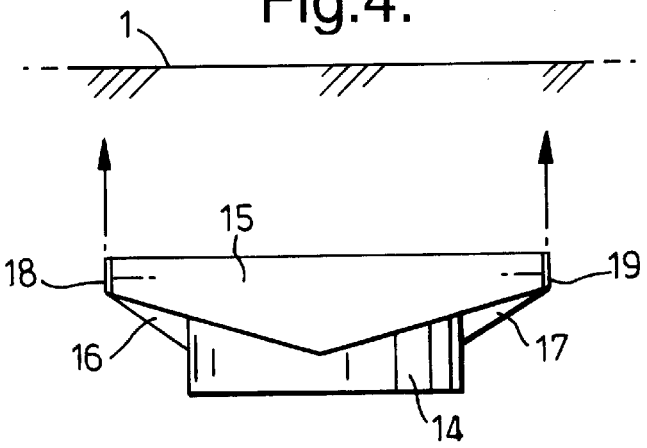
FIG. 4 shows an anchor in the seabed.
Figure 5:
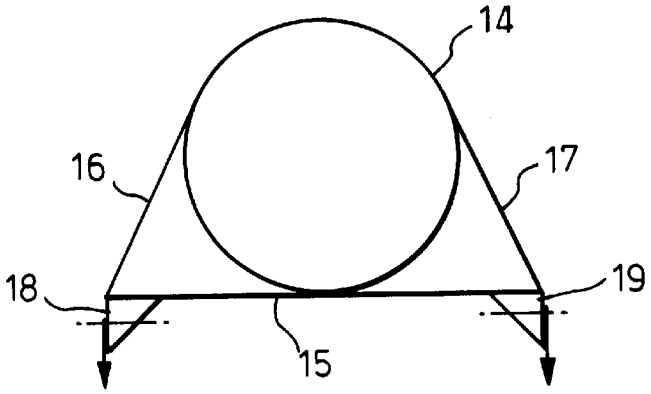
FIG. 5 is a horizontal projection of the anchor in FIG. 4.
Figure 6:
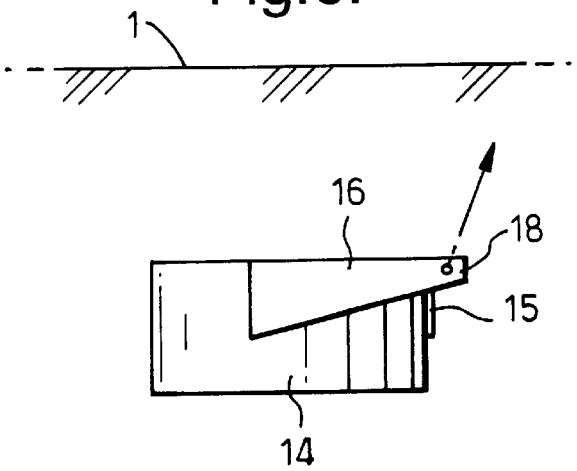
FIG. 6 is a side view of the anchor illustrated in FIG. 4.

FIGS. 4, 5 and 6 show an advantageous embodiment of the anchor. The anchor consists of a hollow cylinder 14, open at both ends, and having a vertical cylinder axis. On the outside of the casing a tangential plate 15 is mounted. This is supported against the hollow cylinder 14 by means of support plates 16, 17. At cach end of the plate 15, at the point where the support plates 16. 17 are attached to the plate 15, attachment lugs 18, 19 are formed for anchor lines, which are indicated by arrows.

The plate 15 enables two anchor lines to be connected to one anchor, and the plate will increase the anchor's capacity and also increase the anchor's width, which makes it possible to attach two or more anchor lines at a distance which is sufficient to prevent the lines from striking against one another if they are set in motion.

Figure 7:
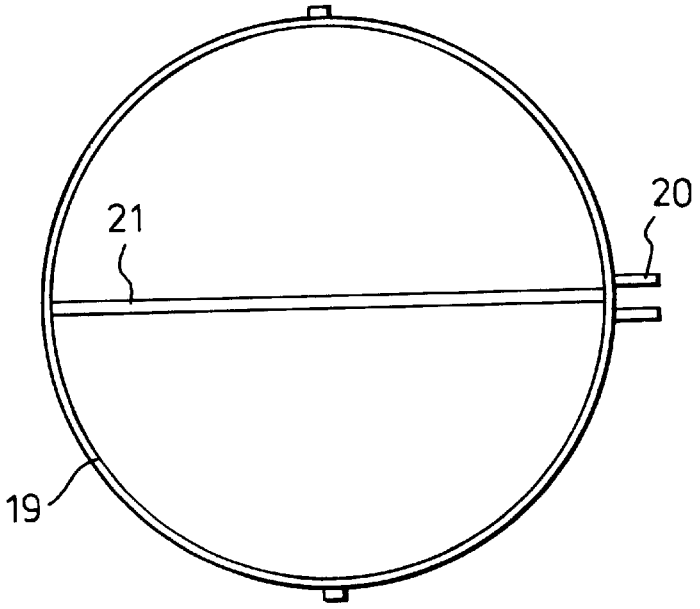
FIG. 7 is a horizontal projection of the anchor according to the invention.

FIG. 7 is a horizontal projection of an anchor according to the invention. The anchor is constructed in the form of a hollow cylinder 19, that is open at both ends, and has an attachment bracket 20 for a non-illustrated anchor cable. The hollow cylinder 19 is provided with a transverse brace 21.

Figure 8:
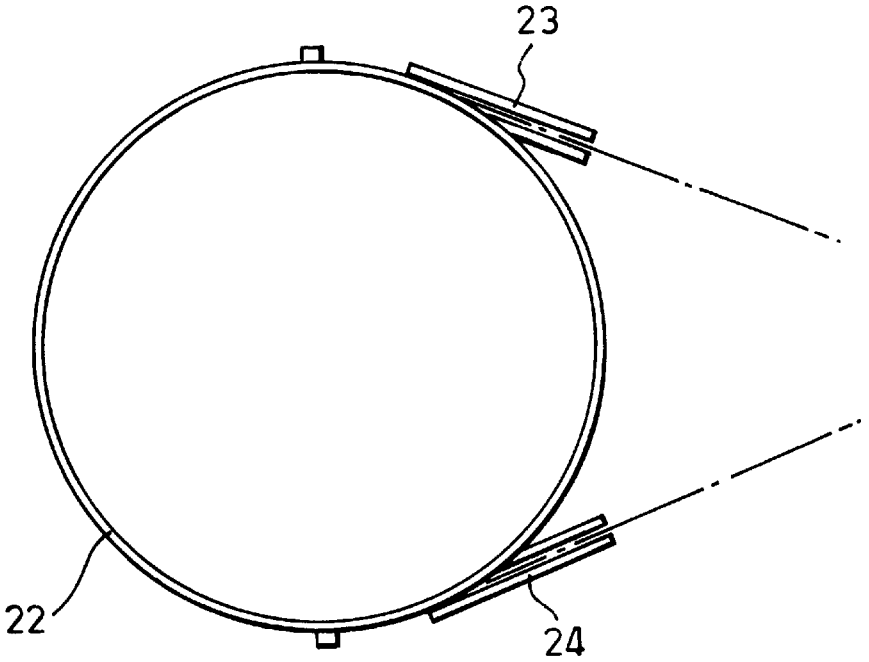
FIG. 8 is a horizontal projection of a second embodiment of an anchor according to the invention.

The anchor in FIG. 8 is also constructed in the form of a hollow cylindrical body 22, open at both ends, but with a two-point connection in the form of attachment brackets 23 and 24. The anchor lines in FIG. 8 arc indicated by means of dotted lines running out from the respective brackets 23, 24. Optionally, there may be a fork of chain or similar, which meets in a triangular plate.

Figure 9:
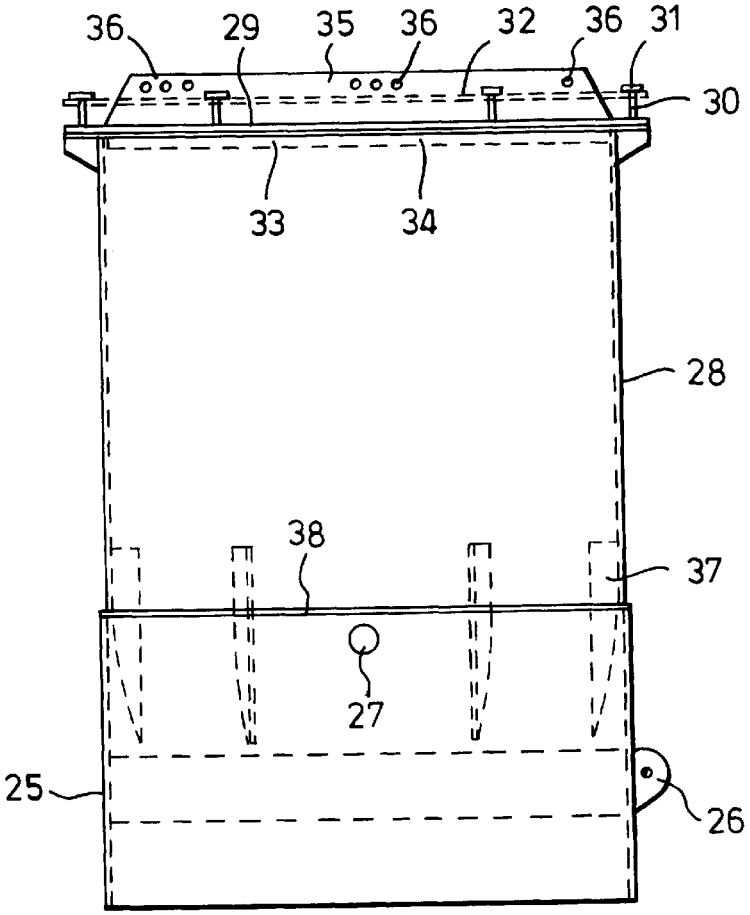
FIG. 9 illustrates a device for use when penetrating the anchor according to the invention, with an anchor connected thereto.
Figure 10:
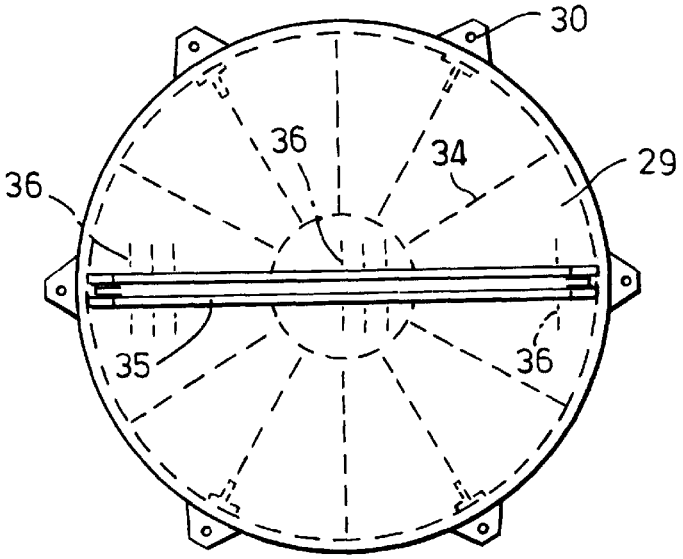
FIG. 10 shows the device in FIG. 9 seen from above.

FIGS. 9 and 10 show an anchor according to the invention, assembled with a top piece which is used as an installation part for the anchor.

The anchor in FIG. 9 is designated 25, and can, for example, have an embodiment as shown in FIG. 3. In addition to the attachment lug 26 for the anchor cable, the anchor has two diametrically opposed pins 27. The purpose of these will be described in detail below in connection with FIG. 11.

The installation part, i.e., the part used for installing the anchor in the seabed, is constructed in the form of an inverted beaker-shaped body, having a cylindrical casing wall 28 and a beaker bottom or cylinder cover 29. The cylinder cover 29 rests loosely on the top of the cylinder casing 28 and is limitedly moveable in that on the top of the cylinder casing 28 there are placed a number of control rods 30 which extend from attachment points on the cylinder casing and through corresponding openings in the cylinder cover 29, said control rods 30 being provided with heads 31 which restrict the movement of the cylinder cover. The possible upper open position of the cylinder cover 29 is shown in dotted lines 32. In the raised position 32, shown in dotted lines, there will be a large free upper vent hole in the top piece.

The control rods 30 are, as shown, located outside the cylinder contour, thereby providing space for a ring gasket 33, not shown in detail here, between the two parts 28 and 29. This ring gasket ensures tight connection between the cylinder cover and the cylinder casing 28 when the cylinder cover 29 rests against the cylinder casing 28. The cylinder cover 29 is shown here as a flat plate braced with bracing elements, e.g., the indicated radial ribs 34, according to need. Other designs of the cylinder cover may be relevant, e.g., in the form of conical shell, a spherical shell or similar.

Two girders 35 are provided on the upper side of the cylinder cover 29. Holes 36 are drilled in these girders for the attachment of lifting equipment for both one-point and two-point lifts. As shown, several holes are drilled to enable the lifting point to be moved above the centre of gravity of the anchor. The anchor may be eccentric, for example because of the location of the anchor attachment, the weight of an optional chain portion and similar.

The cylinder cover 29 may be equipped with an non-illustrated pump or ejector for carrying out suction penetration and for reversing power when removing the installation part. The cylinder cover 29 may also be equipped with suitable non-illustrated equipment for docking a ROV. Such docking may be necessary for the supply of power to hydraulic systems with which the installation part is equipped, and/or power to the pump/ejector.

The intake for the water which is sucked out of the top piece is evenly apportioned across a large part of the top, in order to obtain a low water speed with a small concentration of solids in the evacuated water, which results in the anchor being able to penetrate so deep that the split between the cylinder cover and the seabed mass is small, or non-existent.

The top piece is provided with guiding elements 37 for aligning the top piece and the anchor. A ring gasket 28 can to advantage be inserted between the top piece and the anchor.

Figure 11:
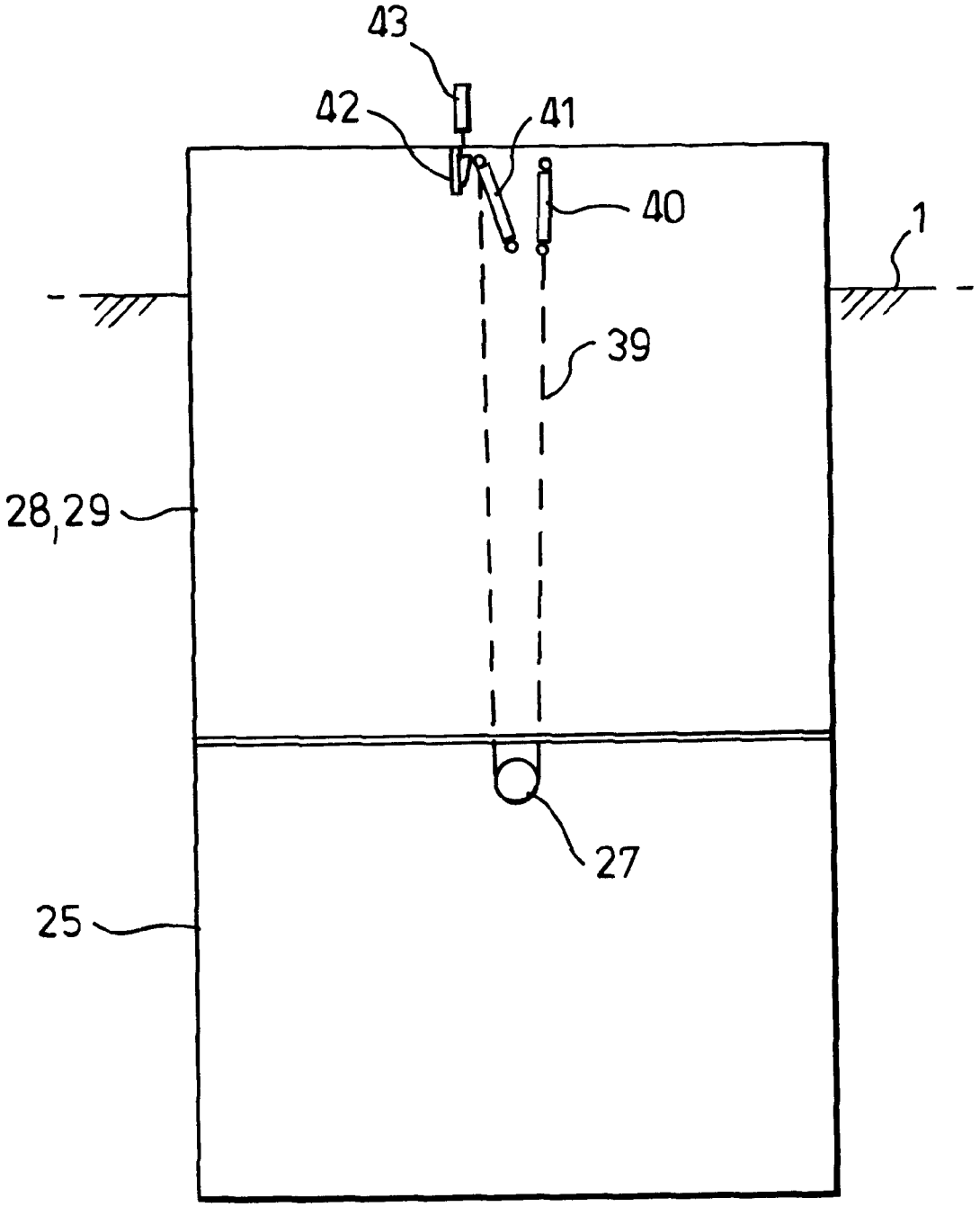
FIG. 11 is a schematic illustration of a device as shown in FIG. 9, with an easily breakable lock connection between the top piece and the actual anchor.

The top piece and anchor c an to advantage be locked together by means of wire loops A possible embodiment of this kind is shown in FIG. 11. A wire 39 is at one end thereof attached to a hydraulic fluid power cylinder 40 (or for example a turnbuckle) which is attached to the top piece. The wire 39 runs down from the fluid power cylinder 40 and around the pin 27, projecting out from the anchor 25, and then up again to a swivel arm 41. This swivel arm is held in place by means of a wedge 42, which can be moved with the aid of a fluid power cylinder 43. Once penetration has been completed the top piece is to be released and detached from the anchor 25, and this happens in that the wedge 42 is pulled up along its guide plate by means of the cylinder 43. When the wedge 42 is pulled up the pretension in the wire 39 is reduced because the swivel arm 41, which holds the wire, will begin to rotate freely, whereby the pretension force in the wire will be neutralised because the wire is released. The wire will then be released and will slide off the pin 27 when the top piece is hauled up. Should the opening mechanism 41–43 fail, release can be effected by cutting the wire 39 with the aid of a ROV above the level of the seabed, which is indicated in FIG. 11 by means of the reference numeral 1.

Alternative solutions for connection may, e.g., include a vertical rod which can be turned, for example by means of a fluid power cylinder, about its vertical axis and in this way detach/release the anchor from the top piece.

During submersion into the sea, the top piece with the hollow cylinder 25 connected thereto is suspended from a lowering wire, which is connected to the cylinder cover 29. The cylinder cover 29 will therefore be in its upper position 32 (FIG. 9) and there will be good ventilation through the thus formed large free hole. Efficient ventilation is thus achieved and the anchor with top piece can therefore pass through the wave zone without any danger of the waves lifting the anchor and the thus connected top piece and taking up the tension in the lowering wire, or the reverse, namely loading the lowering wire with great downwardly directed force.

When the anchor comes to rest on the seabed, the first part of the penetration will take place by means of its own weight, as so-called weight penetration. The cylinder cover will in this phase rest loosely on the cylinder casing or be held in a lifted position, by means of, for example, fluid power cylinders (not shown), which are later used to lower the cylinder cover onto the cylinder casing, so that the weight penetration can be carried out quickly and without any danger of internal positive pressure, which could result in channel formation along the wall, which in turn could result in leaks and a diminished capability to suck the anchor clown to the desired depth. An internal positive pressure in a closed anchor (which occurs in all known suction anchors) may also result in the anchor overturning before it has started to penetrate. These dangers are avoided with the invention, and a safer installation is thus ensured. An extension of the spell of weather which is necessary for carrying out the installation is also obtained because submersion and penetration can be carried out in larger waves than previously. The submersion and penetration can be carried out faster and safer than before.

To achieve suction penetration, the cylinder cover is locked against the cylinder casing. This can take place, for example, as shown in FIGS. 12 and 13, which show respective sections, from the side and above, of an area where a locking mechanism is provided.

Figure 12:
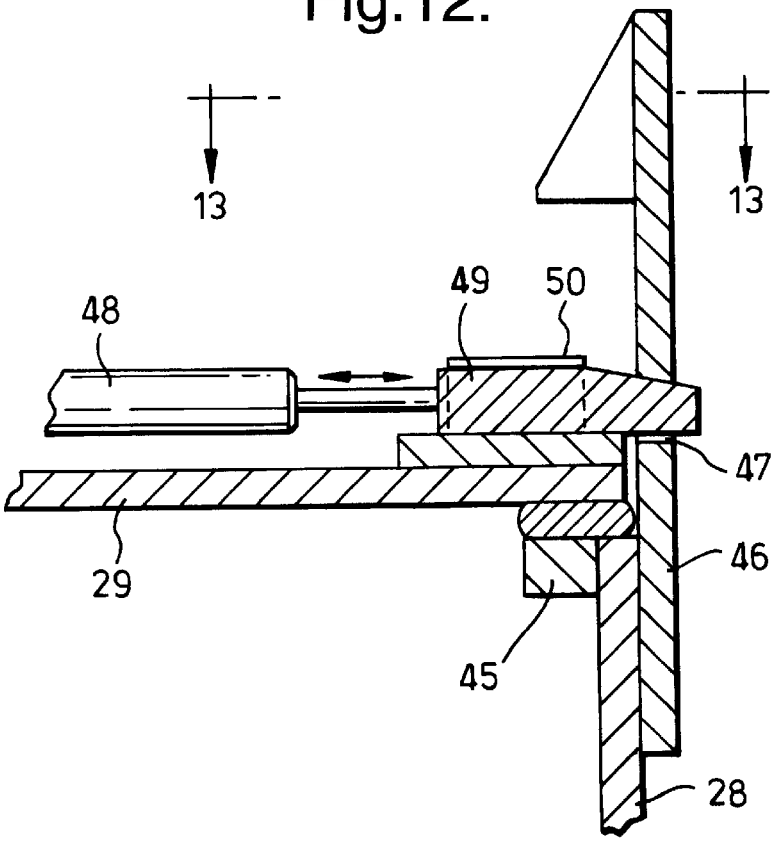
FIGS. 12 & 13 show a detailed section of a possible lock which is used in the top piece according to the invention.
Figure 13:
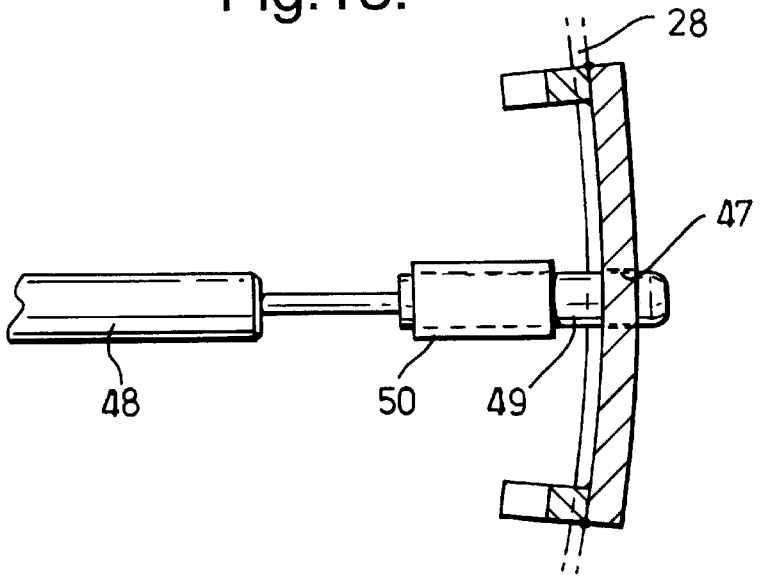

In the section shown in FIG. 12, a partial section of the cylinder casing 28 (see FIG. 9) and cylinder cover 29 can be seen. Uppermost in the cylinder casing 28 a ring 45 is welded in place, thereby producing a contact surface for a ring gasket 33. An upwardly projecting plate part 46 having an opening 47 is welded in place on the outside of the cylinder casing 28, and on the cylinder cover 29 there is provided a hydraulic fluid power cylinder 48 whose piston rod is connected to a wedge 49 which enters a guide means 50. With the aid of the fluid power cylinder 48 the wedge 49 can be wedged into and out of the opening 47, thereby pressing the cylinder cover 29 against the ring gasket 33, or, in fully depressed state, causing the cylinder cover 29 to be released.

Figure 15:
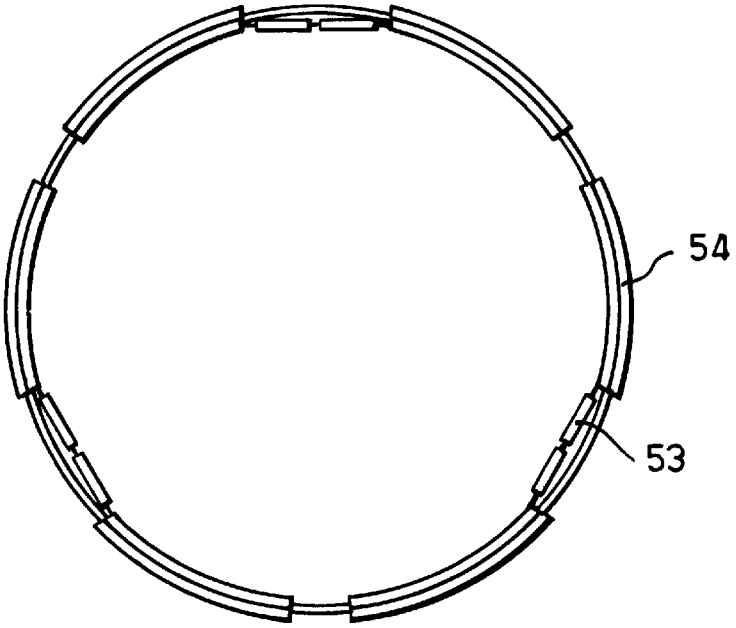
FIG. 15 is a schematic horizontal projection of an anchor according to FIG. 14.
Figure 16:
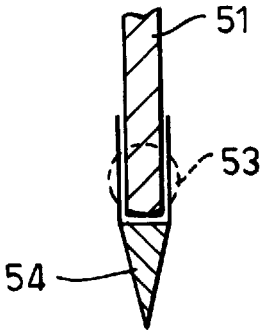
FIG. 16 shows in section a cutting element which is used in the embodiment in FIGS. 14 and 15.

For installation in seabed masses where the gravitation and suction forces are not sufficient for penetration of the anchor to the desired depth, the anchor may be provided with equipment for mechanical digging and/or removal of masses underneath the anchor. Equipment of this kind is shown in FIGS. 14–16.

Figure 14:
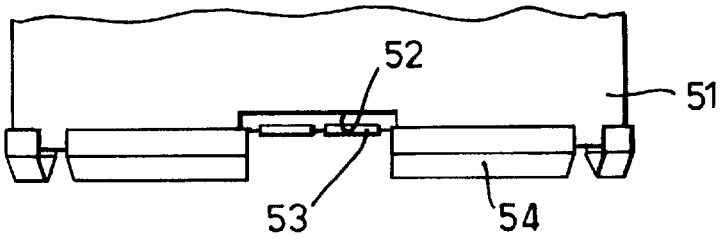
FIG. 14 shows a section of an anchor according to the invention, with cutting elements.

FIG. 14 shows in section the lower part of a hollow cylinder or anchor 51. In the lower end of the hollow cylinder there are provided cut-outs or end recesses 52 where there are arranged hydraulic fluid power cylinders 53. These actuate cutting elements 54 to move to and from in the peripheral direction of the hollow cylinder. The cutting elements 54 are moved in pairs in the opposite direction. Movement of this kind will not cause any rotational moment which could possibly set the whole anchor in motion before sufficient resistance of the surrounding earth masses has been developed. The movement of the cutting elements results in a weakening of the earth masses and a reduction of the penetration resistance.

Hydraulic cylinders may alternatively be located on the inside of the hollow cylinder with suitable protection. This alternative is to avoid the need for recesses.

The penetration resistance can be increased further by supplying water under pressure in the digging zone. A further reduction can also be obtained by pumping loosened masses out of the digging zone.

By giving the cutting elements an independent control, i.e., that the hydraulic fluid power cylinders are attached to independent control, the cutting elements can be used to guide the anchor to penetrate vertically.

The anchor, as will be understood, can be adapted to have a plurality of lines or cables, e.g., for securing flexible risers.

Figure 17:
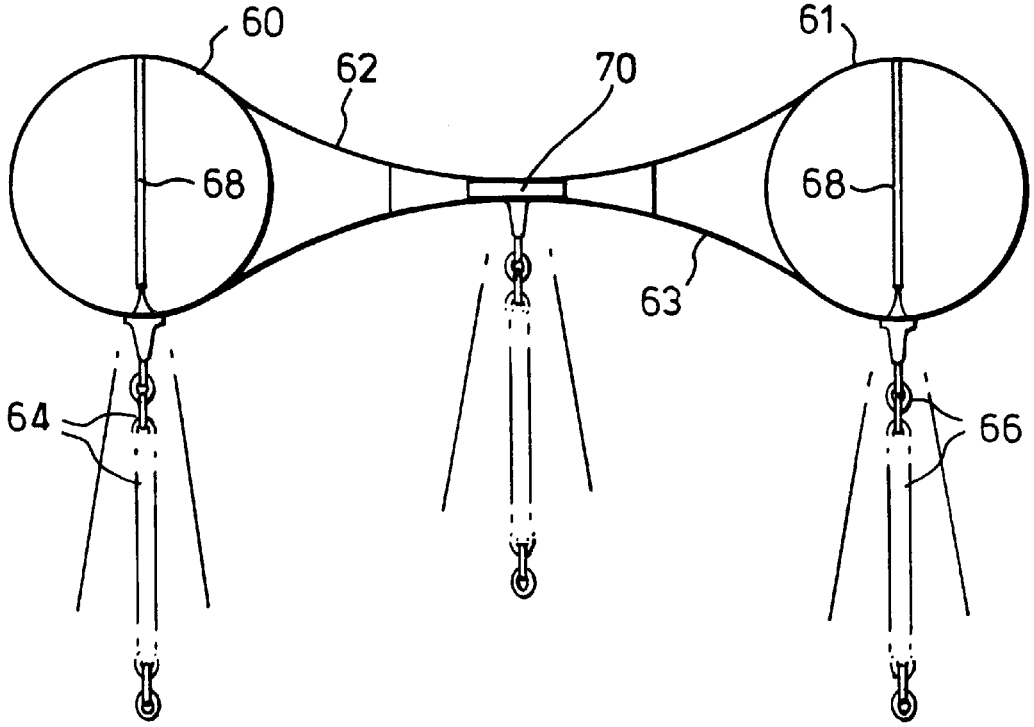
FIG. 17 shows a possible embodiment, with a plurality of hollow cylinders.
Figure 18:
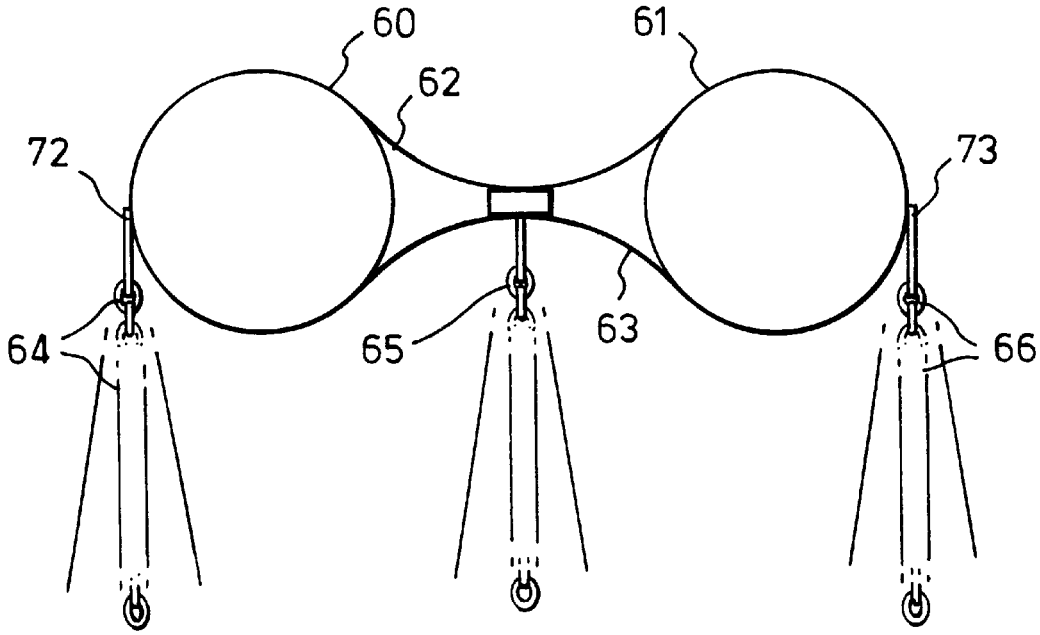
FIG. 18 shows variant of the last-mentioned embodiment.

In FIGS. 17 and 18, a possible embodiment is illustrated where the anchor consists of several hollow cylinders 60,61, in this case two, which are connected to one another with curved plate members 62,63. The number of hollow cylinders and lines or cables, here indicated with chain lengths 64,65 and 66, can vary according to need and taking into account practical aspects associated with the installation of such anchors. The assembly of hollow cylinders in groups results in a rigid and efficient structure with low material consumption.

FIG. 17 illustrates a solution where the outermost anchor lines 64,66 are connected to a central connection point on the cylindrical wall, which is reinforced by means of a transverse plate 68, as in FIG. 7. The middle anchor line 65 is secured to a reinforced mid-point 70. The attachment points are proportioned to withstand large deviations from the theoretical direction of the line, which makes the installation easier and cheaper.

The embodiment in FIG. 18, where the outermost anchor lines are attached to the side, at points 72,73, results in either narrower anchors which may be easier to handle, or that the distance between the lines can be greater without the actual anchor becoming unmanageably large.

Having described my invention, I claim:

1. A subsea mooring, to be penetrated into the seabed with seabed mass on all sides; the subsea mooring comprising:

a vertical hollow cylinder open at both ends;

an anchor cable connected to the hollow cylinder; and a plate fastened to the hollow cylinder tangentially.

2. The subsea mooring according to claim 1, wherein the hollow cylinder comprises a plurality of hollow cylinders and wherein the plate is fastened to at least one of the plurality of hollow cylinders.

3. The subsea mooring according to claim 2, wherein the hollow cylinders are spaced apart at generally equal intervals.

4. The subsea mooring according to claim 2, wherein the hollow cylinders are connected to each other by the plate.

5. The subsea mooring according to claim 1, wherein the plate is curved in a horizontal plane.

6. The subsea mooring according to claim 1, comprising a plate support running between the hollow cylinder and the plate.

7. The subsea mooring according to claim 1, wherein the anchor cable comprises a chain length extending therefrom up to a seabed surface and wherein, in a penetration region in the seabed, the chain length is connected to a plate body resting on the seabed and to the anchor cable, which continues to run upward therefrom.

8. The subsea mooring according to claim 1, wherein the anchor cable, between the hollow cylinder and a seabed surface, comprises a number of cable bodies threaded thereonto.

9. The subsea mooring according to claim 8, wherein the cable bodies are generally cylindrical.

10. The subsea mooring according to claim 9, wherein respective diameters of the cable bodies decrease with distance from the hollow cylinder.

11. The subsea mooring according to claim 1, wherein the plate is substantially vertical.

* * * * *